US006253394B1

(12) United States Patent
Goyette et al.

(10) Patent No.: US 6,253,394 B1
(45) **Date of Patent: *Jul. 3, 2001**

(54) MULTI-FUNCTIONAL AND TRANSPORTABLE WASH STATION

(75) Inventors: Dominic T. Goyette, Grand Blanc; Carl M. Burke, Davison, both of MI (US)

(73) Assignee: Goyette Mechanical Co., Flint, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/885,824

(22) Filed: Jun. 30, 1997

(51) Int. Cl.[7] ..... A47K 1/02
(52) U.S. Cl. ..... 4/626; 4/638
(58) Field of Search ..... 4/516, 619, 624, 4/625, 626, 630, 638, 653

(56) References Cited

U.S. PATENT DOCUMENTS

| | | | | |
|---|---|---|---|---|
| 3,045,252 | * | 7/1962 | Sorrells | 4/626 |
| 4,130,123 | * | 12/1978 | Wines, Jr. et al. | 4/626 X |
| 4,163,294 | * | 8/1979 | Patterson | 4/449 |
| 4,998,302 | * | 3/1991 | Silva | 4/516 |
| 5,031,258 | | 7/1991 | Shaw | 4/623 |
| 5,148,552 | | 9/1992 | Kress et al. | 4/252.2 |
| 5,199,118 | | 4/1993 | Cole et al. | 4/619 |
| 5,257,423 | | 11/1993 | Jacobsen et al. | 4/630 |
| 5,526,539 | * | 6/1996 | Bower et al. | 4/516 |
| 5,687,434 | * | 11/1997 | Tagg | 4/625 |

FOREIGN PATENT DOCUMENTS

| | | | | |
|---|---|---|---|---|
| 3011303 | * | 10/1981 | (DE) | 4/638 |
| 2118533 | * | 7/1972 | (FR) | 4/624 |

OTHER PUBLICATIONS

English language translation of FR 2,118,533, Jul. 1972.*

* cited by examiner

*Primary Examiner*—Robert M. Fetsuga
(74) *Attorney, Agent, or Firm*—Gifford, Krass, Groh, Sprinkle, Anderson & Citkowski, P.C.

(57) ABSTRACT

A multi-functional and transportable wash station for use in an industrial facility, the facility having overhead extending pressurized water supply lines and waste water drainage lines. The wash station includes a body with a polygonal shaped base and a superstructure extending upwardly from the base. An inlet supply line extends from the body and is operatively connected to a selected water supply line of the facility. A selected number of both potable and non-potable water supply sources, such as faucet and sink stations, faucet and hose connections, drinking fountains and emergency shower stations are provided at specified locations of the wash station and are in communication with the inlet supply line. An electric power input is provided to the wash station and operates such features as a sewage ejection pump, a water heater and a water chiller. Drainage lines within the wash station collect dirty water from the potable and non-potable sources into a common outlet waste line extending from the station body and effluent the dirty water to a selected waste water drainage line within the facility.

11 Claims, 4 Drawing Sheets

MULTI-FUNCTIONAL AND TRANSPORTABLE WASH STATION

BACKGROUND OF THE INVENTION

1. Field of the Invention

The present invention relates generally to wash station devices which are particularly suited for industrial applications and, more particularly, to a multifunctional and transportable wash station which is capable of being easily accessed by existing fluid lines within an industrial facility.

2. Description of the Prior Art

Employee wash stations which are particularly suited for commercial and industrial use are well known in the art. Such stations are typically found in communal wash areas which are usually located close to locker rooms or employee changing areas within a facility. A common type of hand/arm wash station known in the art utilizes a large circular shaped and open interior basin with a central and upwardly extending faucet which is capable of issuing water in a plurality of discrete streams. Users of the wash station stand around its outer circumference and are able to use either a detergent or liquid supplied soap in combination with selected streams of the issuing water.

Additional examples of hand was stations are illustrated in U.S. Pat. No. 5,031,258, issued to Shaw, and U.S. Pat. No. 5,199,118, issued to Cole et al. Both Shaw and Cole teach a variation of a wash station with sink and faucet and hand drying means. In the case of Shaw, an infrared sensor senses the presence of a user and activates the connected water source as well as an electrically operated roll towel for permitting the user to dry his/her hands. Cole likewise teaches infrared sensing technology with a first such sensor being activated for issuing both soap and running water for specified time intervals and a second sensor for activating an electric hot-air dryer positioned overhead the faucet and sink. A shortcoming of the prior art devices such as discussed above is that they are fairly limited in most instances to hand wash applications and specific water inlet and drainage requirements require that the devices be located in specified areas only.

SUMMARY OF THE INVENTION

The present invention is a multi-functional and transportable wash station for use in an industrial facility which is capable of providing a variety of potable and non-potable water sources and which is easily transported to and from any locations within an existing facility and installed to existing water supply and waste water drainage lines which are located within the facility. The wash station includes a body having a polygonal shaped base and a superstructure extending upwardly from the base.

An inlet supply line extends from the body and connects to a selected one of the overhead pressurized water lines of the facility to provide an input water supply to the station. A plurality of potable and non-potable water supplies are located on the wash station, among which include faucet and sink stations, faucet and hose connections, drinking fountains, emergency shower stations and the like. A bucket dump station is also located on an upper surface of the wash station base and includes a hingedly connected lid which is upwardly pivoted to reveal a dirty water/waste tank formed within an interior of the base.

A series of drainage lines are provided within the wash stations and are assigned as water return lines for the various potable and non-potable water supplies. The drainage lines collect into the dirty water/waste tank and a sewage ejection pump forces the dirty water through an outlet waste line extending upwardly from the washing station body and into an overhead waste water drainage line in the facility. Alternatively, a gravity discharge drain hole covered by a drain cap is located at a position proximate a bottom of the washing station base and, assuming available ground drainage is located in the facility, can be utilized to drain dirty water from the base located tank.

Located on an underside of the wash station base are first and second elongate extending members, each of which include a downwardly facing "U" shape in cross section and extend in parallel fashion such that the elongate members are capable of receiving inserting portions of a conventional hydraulic operated fork lift. The wash station is therefore capable of being lifted and relocated throughout an industrial facility with the use of existing and widely available loading equipment and then quickly reconnected with minimal plumbing requirements to the existing water supply and waste water drainage lines within the facility. Accordingly, the present invention provides a multi-use wash station which is a major improvement over fairly simplified and restrictive wash stations according to the prior art.

BRIEF DESCRIPTION OF THE DRAWINGS

Reference will now be made to the attached drawings, when read in combination with the following specification, wherein like reference numerals refer to like pa throughout the several views, and in which.

DESCRIPTION OF THE PREFERRED EMBODIMENTS

Figure 1:
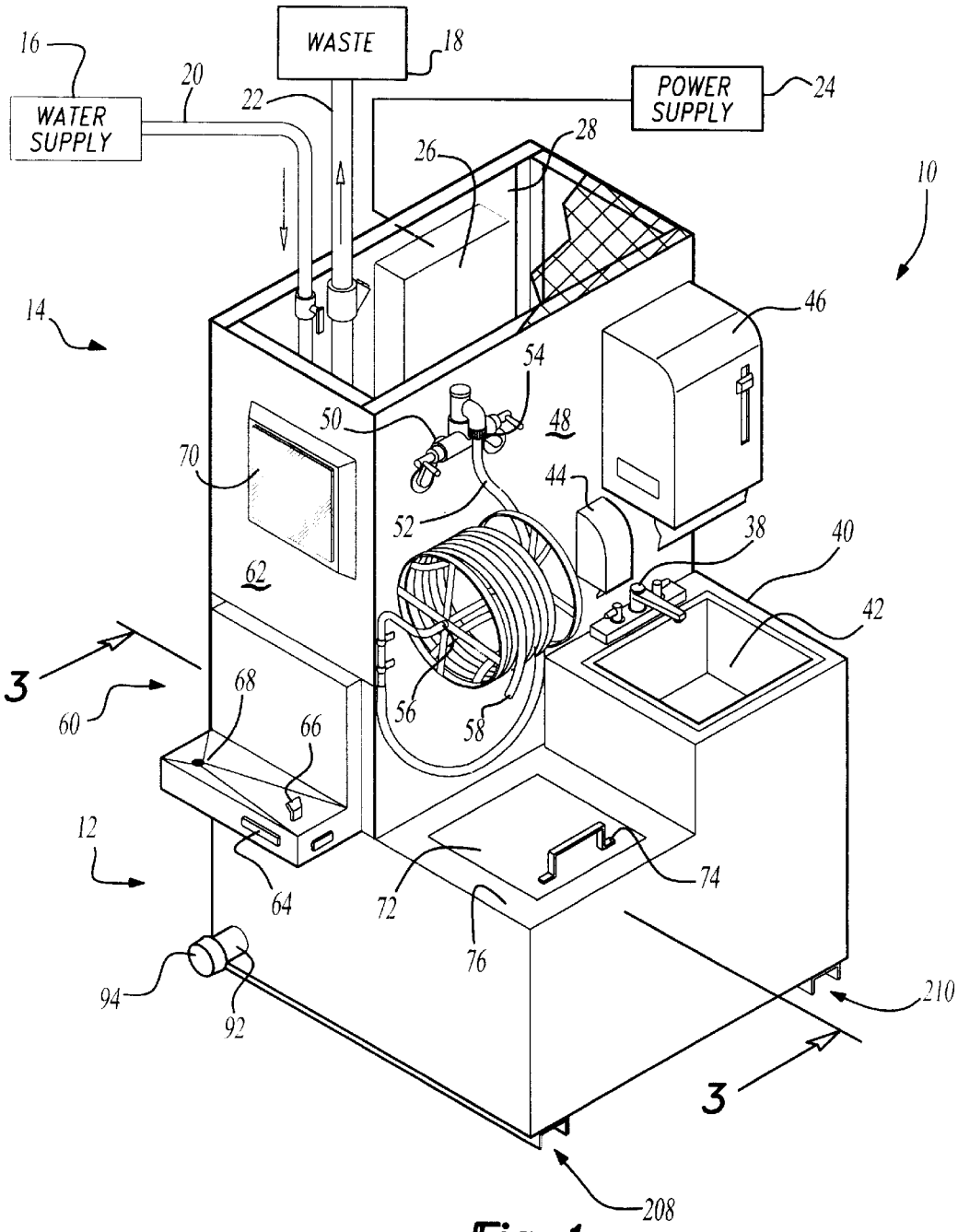
FIG. 1 is a perspective view in partial cutaway of the multi-functional and transportable wash station according to a preferred embodiment of the present invention.

Referring to FIG. 1, a multi-functional and transportable wash station 10 is shown according to a preferred embodiment of the present invention for providing employees within an existing industrial facility a wash station capable of delivering pressurized water for a variety of potable and non-potable uses at any desired location and further requiring minimal transport and installation. The wash station 10 possesses an integral body constructed of a steel or preferably like metal shell exterior which consists of a polygonal shaped base 12 and an upwardly extending superstructure 14. The base 12 can be of any desired polygonal shape but according to the preferred embodiment is rectangular in cross section with first, second, third and fourth sides and the superstructure 14 is likewise preferably rectangular with four sides. The existing facility is typically of the type in which substantial industrial activity occurs, specifically manufacturing and/or treatment of materials, and includes a number of pressurized water supply lines, indicated in FIGS. 1 and 3 by supply line 16, as well as a number of drainage waste water lines, again indicated by waste line 18.

An inlet supply line 20 extends upwardly from the superstructure 14 of the wash station 10 and connects to the selected overhead and pressurized water supply line 16, such as by welding. A waste outlet line 22 likewise extends upwardly to connect to the selected waste water drainage line 18. The purpose of the inlet supply line 20 is to provide pressurized water for subsequent use by the potable and non-potable supply locations and the waste outlet line 22 to effluent the collected or dirty water after it has been used in the selected applications.

Figure 5:
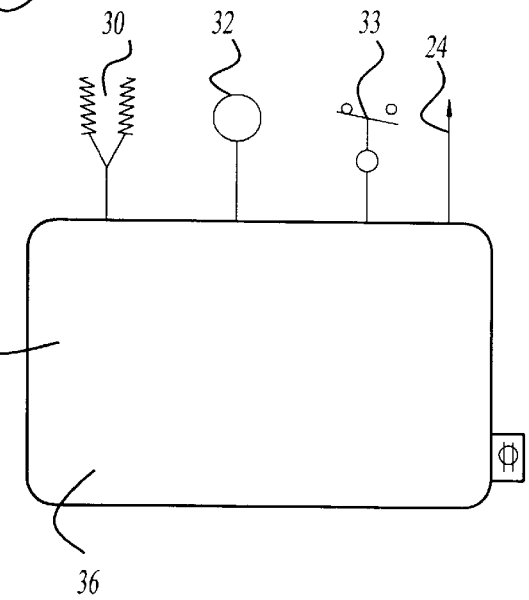
FIG. 5 is a schematic view of a power input and control box of the multi-functional and transportable wash station according to the present invention.

An exterior electrical power supply line 24 of the facility inputs to an electrical control panel 26 mounted within an open interior 28 of the wash station superstructure 14. As is further illustrated with reference to FIG. 5, the control panel 26 receives the power input supply from the facility at 24, such supply typically being a 480 volt, three-phase 60 ampere alternating current. The control panel 26, as will be further described with reference to FIGS. 7 and 8, selectively operates water treatment accessories within the wash station 10 such as an resistance operated and instant water heater 30 for providing heated water, an electrically operable sewage ejection pump 32 for effluenting the waste water from the potable and non-potable applications, a float/no float switch 33 incorporated into an interior of the base 12 and to determine if a waste collection tank 34 requires emptying and a (see also FIG. 3) delivering a supply of cooled water. The waste collection tank 34 is preferably a steel welded tank within the base which is capable of holding any desired volume of fluid, depending upon the size of the base, but which is in the preferred embodiment specified to hold at least 11 gallons of waste fluid.

Referring again to FIGS. 1, 2 and 3, the wash station 10 illustrates a variety of different potable and non-potable water supply locations, which are identified as follows. A conventional faucet 38 with hot and cold water flow and a dispensing spigot is provided atop a selected surface 40 of the wash station base 12 and empties flow from the faucet 38 into a stainless steel sink 42 formed into the selected base surface 40 and further including a drain hole 43 located at the bottom of the sink 42. The faucet 38 and sink 42 station is typically a hand wash station and additional accessories such as a soap dispenser 44 and towel dispenser 46 are mounted to a vertically extending surface 48 of the superstructure 14 in proximity to the faucet 38 and sink 42.

Also shown mounted to the vertically extending surface 48 of the wash station superstructure is an additional faucet 50, likewise including both hot and cold water flow and a dispensing spigot. A running length of hose 52 is secured to the faucet spigot at a first end 54 and is wound about a rotating drum member 56 along its length and terminates in a second selected end 58 which is capable of being unwound to establish the length of the hose 52 and to reach a remote location from the wash station.

A conventional electric operable drinking water dispenser and cooler 60 is secured to a further vertically extending surface 62 of the superstructure 14 and, as is known with such conventional units, includes an on/off flow button 64 which is depressed to activate a flow of water through a nozzle 66, the unconsumed portion of which subsequently recollects upon a drainage sink 68. The construction and operation of the drinking water dispenser and cooler 60 is well known in the art and the power supply line 24 and control panel 26 may also be operatively connected to the water dispenser and cooler 60 to provide chilling of the dispensed water. As is well known in the art, the drinking water dispenser 60 also may include internal filtration means for purifying the input flow water which may be provided alone or in combination with additional water purifying through the potable input line. A planar shaped mirror portion 70 may also be mounted to the vertically extending surface 62 of the superstructure.

Figure 3:
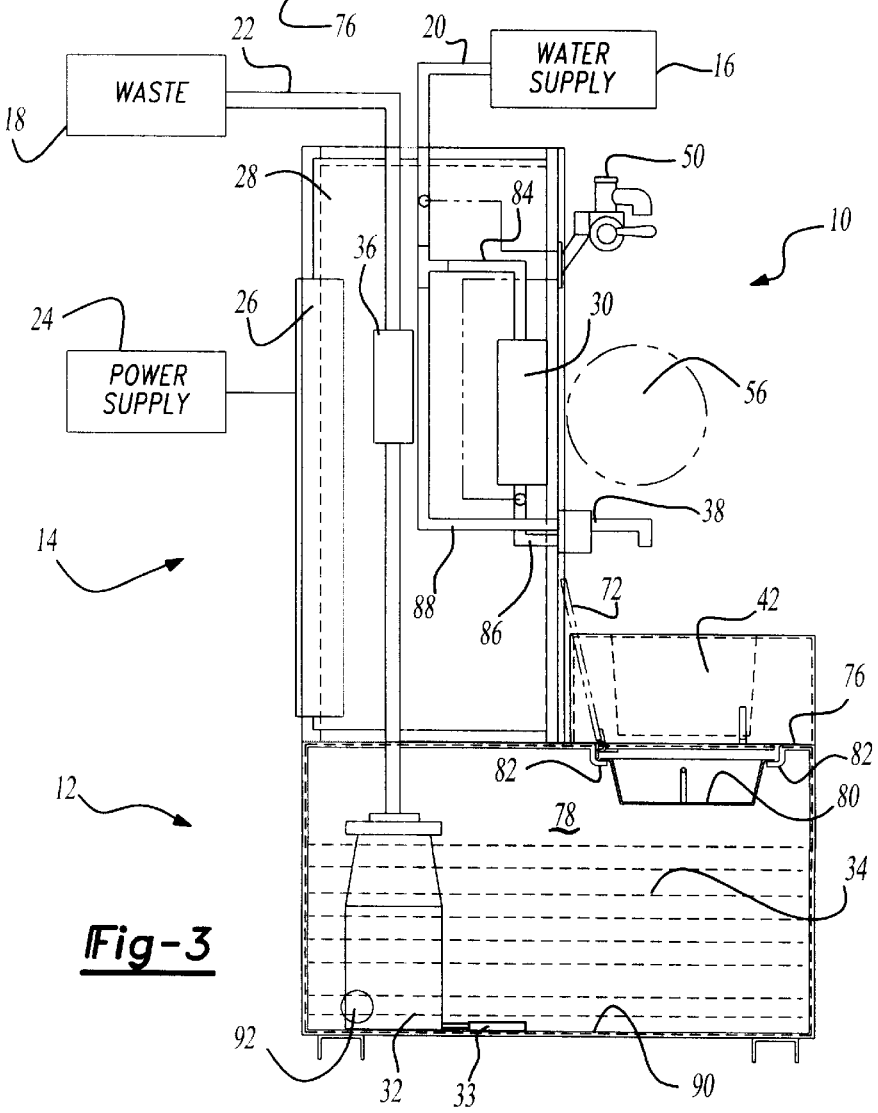
FIG. 3 is a vertical cutaway along the lines indicated in FIG. 1 and illustrating a side view of the base, superstructure and interior of the wash station according to the preferred embodiment of the present invention.

A lid 72 includes a handle 74 and is hingedly connected along an edge to a further upwardly facing surface 76 of the wash station base 12. As is best shown in FIG. 3, the lid 72 is rotated upward to reveal an open interior 78 of the base within which the waste collection tank 34 is provided. A particulate filter basket 80 is suspended within the open interior 78 by inwardly configured ledge supports 82 and functions to filter out any solids or particulates from waste water which is introduced into the collection tank 34 such as by dumping the contents of a waste bucket into the open interior.

As is also best illustrated in the cutaway view of FIG. 3, the manner in which the inlet supply line 20 provides pressurized water supply from the water supply lines of the facility to the water supply locations is shown and includes feed line 84 which branches from the inlet supply line 20 and introduces a flow of water through the electrically resistant and instant water heater 30. An outlet line 86 of the heater 30 is illustrated which feeds directly to a hot water supply of the faucet station 38. A cold water line 88 extends directly from the inlet supply line 20 to a corresponding cold water supply of the faucet 38. While not shown, it is also understood that additional feed lines are provided which branch from the inlet supply line 20 and provide hot and cold running water to the faucet assembly 50 for dispensing through the hose 52.

The discharge pump 32 is illustrated mounted to a floor 90 of the base 12 within which is provided the waste tank 34 and is operatively connected to the upwardly extending outlet waste line 22. The float switch 33 is located upon the floor 90 and is operatively connected to the pump 32 to selectively activate the pump 32 when it is necessary to effluent a volume of dirty water collected within the tank and out the outlet waste line 20 and facility waste water drainage line 18. According to a further preferred embodiment, and assuming satisfactory floor drainage in the facility exists, a gravity discharge drain 92 is provided and includes a selectively removable drain cap 94. The wash station 10 in this further embodiment is simply positioned such that the drain 92 is located above the existing floor drain of the facility and the cap 94 removed so that the collected dirty water within the waste tank 34 is simply allowed to drain out of the body without the need of the vertically extending outlet waste line 22 or operation of the discharge motor 32. Referring again to FIG. 2, a level control element 96 is provided for establishing level positioning of the wash station upon a facility floor and is typically provided by Square D component D# 9037 as is known in the art.

Figure 4:
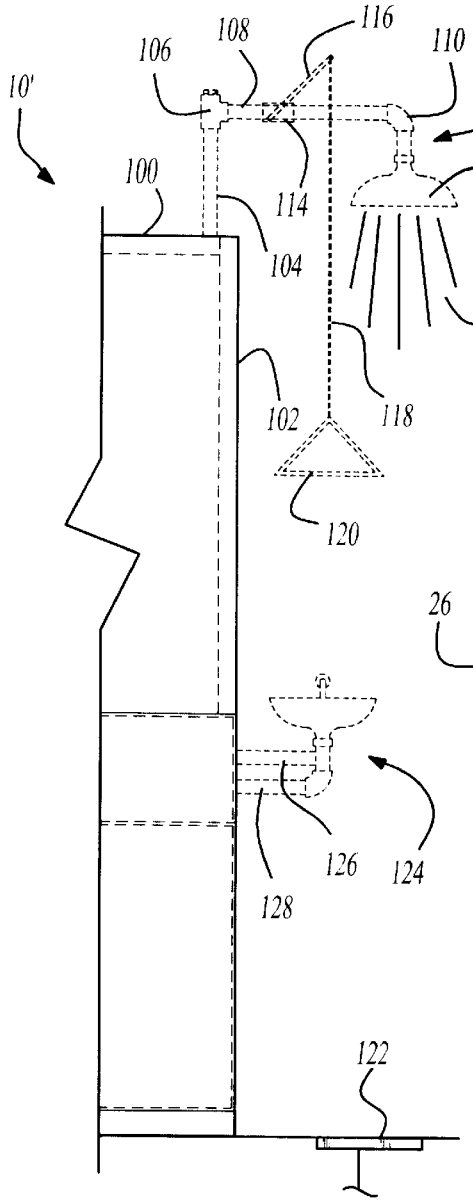
FIG. 4 is a partial view in vertical cutaway of a wash station according to a further preferred embodiment with emergency show station according to the present invention.

Referring to FIG. 4, an emergency shower station 98 is shown according to a further preferred embodiment 10' of the wash station according to the present invention. The shower station 98 extends upwardly from a top surface 100 of a superstructure of the wash station 10' and consecutively outwardly a selected distance past a further vertically extending side 102. The station 98 includes a feed line 104 which extends upwardly from the wash station 10', connects a conventional T-fitting 106, and extends horizontally through an interconnecting line 108 the selected horizontal distance past the vertically extending side 102. The line 108 terminates in an elbow fitting 110 and extends downwardly to a shower dispensing head 112. An on/off flow valve 114 is located at a selected point within the horizontally extending fluid supply line 108 and is operated by a pivotal stem portion 116 which is selectively downwardly actuated by a chain 118 which is provided at a lower end with a triangular shaped gripping handle 120.

The purpose of the emergency shower station 98 is to provide the operator with access to an immediate pressurized flow of clean water 121 from the shower head 112 at any desired location of the wash station within the facility, such as in proximity to an area where dangerous chemicals are being handled and which would otherwise potentially result in burns or toxic reactions if such a shower station were not present. A drain 122 is preferably provided in the floor surface of the facility in proximity to the emergency shower station 98 to provide for drainage of the water flow 121 which is issued exterior of the wash station body. The further preferred embodiment 10' of the wash station may also include another type of conventional drinking faucet 124 with a first water feed line 126 branching from the inlet supply line of the station and a second water return line 128 which discharges used water to the waste tank for subsequent removal from the station.

Figure 2:
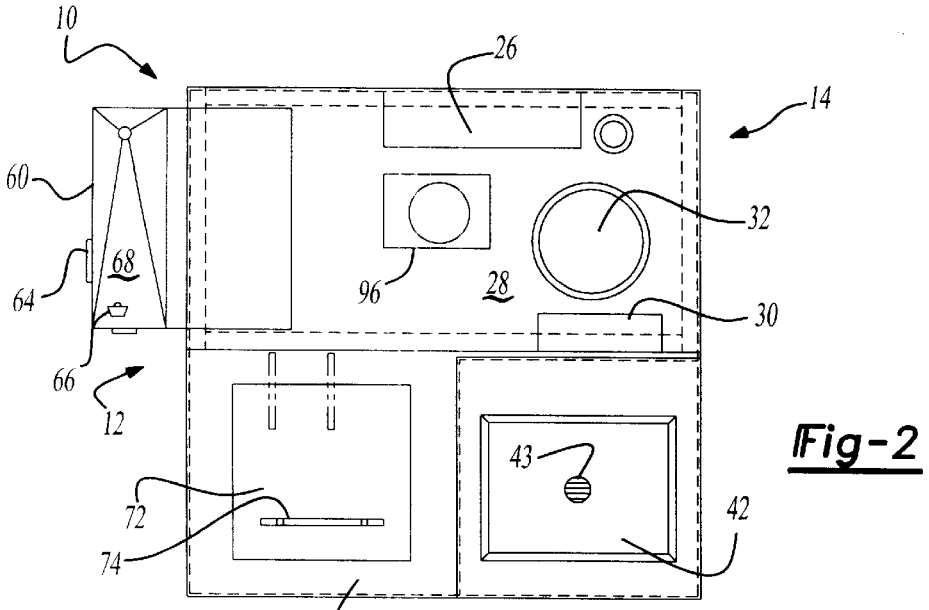
FIG. 2 is a horizontal cutaway along the lines indicated in FIG. 1 and illustrating a downward view of the interior of the wash station according to the preferred embodiment of the present invention.
Figure 6:
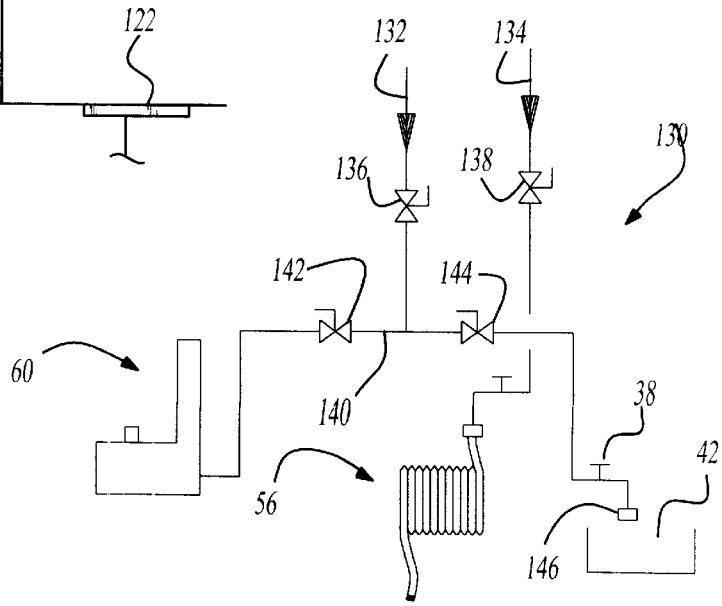
FIG. 6 is a water supply and flow diagram illustrating the application of potable and non-potable water supplies according of the multi-functional and transportable wash station according to the present invention.

Referring to FIG. 6, a water supply flow diagram 130 is shown of an arrangement of potable and non-potable supply locations such as are disclosed in the preferred embodiment of FIGS. 1–3. In the preferred embodiment, the water input to the wash station 10 is illustrated by the single inlet supply line 20 however the schematic of FIG. 6 identifies a first potable water input supply 132 and a second non-potable water input supply 134 and it is understood that the input supply line 20 can either consist of individual input lines for the potable, non-potable supplies or a single line which branches into lines 132 and 134 within the wash station.

Check valves 136 and 138 are provided for the potable and non-potable supply lines 132 and 134 and the lines 132 and 134 feed separately into a main supply line 140. A check valve 142 is located between potable supply line 132 and the drinking fountain station 60 and, when open, permits potable fluid flow to the drinking fountain 60. A further check valve 144 is also located along main supply line 140 between the potable 132 and non-potable 134 inputs and directs the non-potable flow to the faucet 38 and sink 42 station as well as the hose connection 56. As an added feature an anti-siphon vacuum breaker 146 is provided at the spigot of the faucet assembly 38 to prevent inadvertent non-potable water flow into the potable lines, especially during operation of both the potable and non-potable sources.

Figure 7:
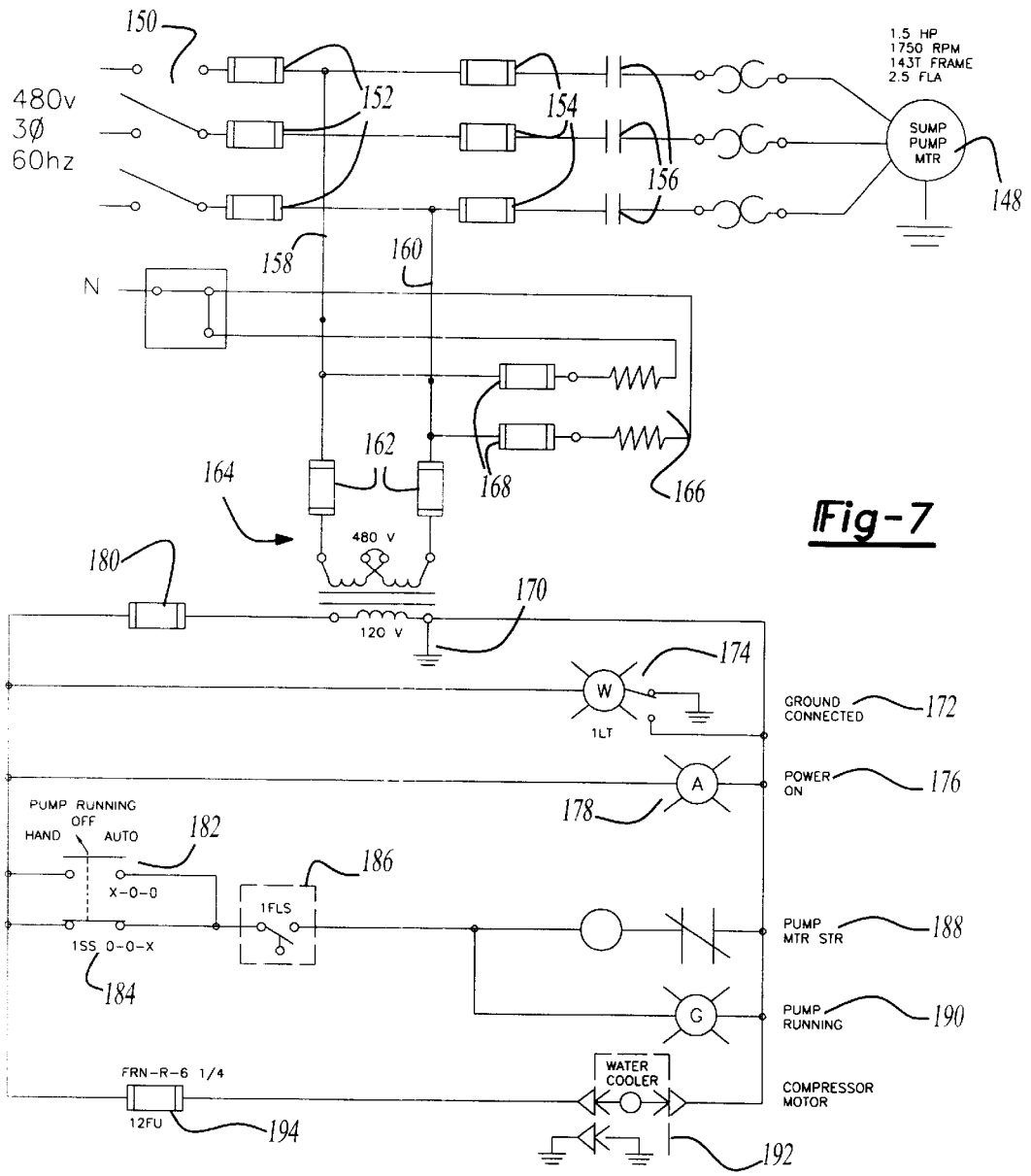
FIG. 7 is an electrical switch diagram illustrating the operation of the power input means to the electrically powered components of the multi-functional and transportable wash station according to the present invention.
Figure 8:
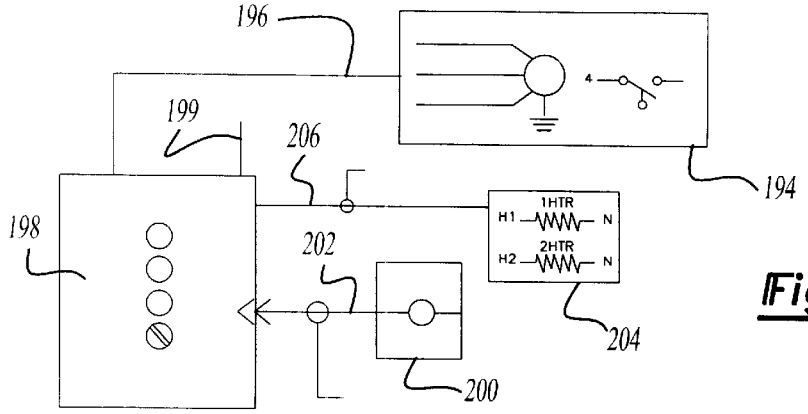
FIG. 8 an equipment layout diagram illustrating a control panel in communication with various of the electrically powered components of the multi-functional and transportable wash station according to the present invention.

Referring finally to FIGS. 7 and 8, an electrical switch diagram and equipment layout diagram are shown which describe in further detail the functioning of the various electrically operable components incorporated into the wash station of the present invention. Referring to FIG. 7, the sewage ejection pump is illustrated schematically at 148 and according to the preferred embodiment is specified at 1.5 horse power and 1750 revolutions per minute to satisfactorily effluent the collected waste in the tank 34 out the waste line 22. The power input is further schematically identified at 150 and is preferably specified at a 480 volt, three phase alternating current at 60 hertz, such a setting being commonly provided within an existing facility or easily achieve through the use of commonly available current rectifying components. Pluralities of fuses 152 and 154 are further illustrated schematically and are provided within the actual control box shown at 26 in the accompanying Figures and, in combination with capacitor elements 156, protect the sewage ejection pump 148 from damage due to a power surge.

Electrical lines 158 and 160 extend from the main power input 150, through additional fuses 162, and to a power transformer 164. Concurrently, the instant water heater 166 is illustrated schematically in communication with the electrical lines 158 and 160 and shielded by fuses 168 to provide an instant source of hot water upon demand. The instant water heater is typically of a type commercially known as E-Max# EX200P and the resistor coils within the heater are activated upon a flow of water through the unit in order to heat the water by combined convection and conduction heat transfer.

Referring again to FIG. 7, the transformer 164 is connected to ground at 170 and is operable to convert the power input source to a modified AC or steady state DC current flow to operate the remaining components of the wash station. A connection to ground is indicated at 172 by pilot light 174 and power on signaling is provided at 176 by pilot light 178. Flow of the transformed current also passes through fuse 180 and into the float/no float switch assembly, identified elsewhere at 33 but shown in FIG. 7 at 182. As was previously described, the float switch assembly 182 is in a preferred embodiment incorporated into a unit on the floor of the waste tank 34 or at another appropriate position in electrical communication to the sewage ejection pump and which is capable of determining any amount of fluid waste being held within the tank 34.

The switch assembly includes a multi-position selector switch 184 which is communicated by a float switch element 186 to determine the existence of waste to be discharged and, upon the float switch element 186 switching to a position indicating the existence of waste within the tank 34, instructs the pump motor relay 188 to activate the pump and is identified as operating by pilot light 190. Upon substantial discharge of waste fluid from within the tank 34, the float switch element 186 will then reseat upon the floor of the tank 34, causing a signal to be sent to the multi-position selector switch 184 to shut off the sewage ejection pump. Also, a water cooler element connected to ground is illustrated at 192 and is provided power by its associated electrical connection and through a fuse 194 for operating an internal compressor element of the cooler/chiller. The water cooler element may form an internal component of a drinking fountain construction for providing chilled water or may be a separate unit provided elsewhere within the wash station construction for providing a chilled source of water for typically potable but also non-potable uses.

Referring finally to FIG. 8, a simplified equipment layout schematic identifies the pump again at 194 with float/no float switch, the pump being connected by a line 196 to a main control box 198 mounted within the wash station. The main control box 198 is provided with the input power supply through line 199 and in turn operates a water cooler 200 through line 202 and instant water heater 204 through line 206. As has been previously described, other electrically powered features may also be provided, such as additional water heating capacity or chiller units and it is also contemplated that standardized plug in outlets may be provided at selected locations along the wash station.

Referring once again to FIG. 1, the transportable nature of the multifunctional wash station of the present invention will now be explained and includes the provision of a first elongate extending member 208 and a second elongate extending member 210 which are secured at selected spaced apart and parallel extending locations along a bottom surface of the wash station base 12. The elongate extending members 208 and 210 each include a downwardly facing "U" shape in cross section such that the bottom of the wash station is spaced a slight distance above the floor of the facility and inserting portions of a conventional hydraulic operated fork lift may be receiving within the "U" shaped interior channel of the extending members 208 and 210 for successively lifting, transporting and reestablishing the wash station at various selected locations throughout the facility. The transport of the wash station is performed in conjunction with the separation and reattachment of the inlet supply and outlet waste lines of the station which are capable of being quickly separated and reattached to selected overhead water supply and water drainage lines existing within the facility.

Having described my invention, it is apparent that the present invention discloses a novel and useful multifunctional wash station which provides a variety of potable and non-potable water supplies at desired locations throughout an existing industrial facility and which is further capable of being quickly transported to locations throughout the facility and tied into existing overhead flow lines. Additional embodiments will become apparent to those skilled in the art to which it pertains without deviating from the scope of the appended claims.

I claim:

1. A multi-functional and transportable wash station for use in an industrial facility, the facility having pressurized water supply lines and waste water drainage lines, said wash station comprising in combination:

a body having a polygonal shaped base and a superstructure extending upwardly from said base;

an inlet supply line extending from said body to which a selected one of the pressurized water supply lines of the facility is capable of being connected;

at least one potable water supply communicating with said inlet supply line and being issued at a first location from said body;

at least one non-potable water supply communicating with said inlet supply line and being issued at a second location from said body;

drainage lines within said body which collect dirty water from said potable and non-portable water supplies, an outlet waste line in communication with said drainage lines and extending from said body and to which a selected one of the waste water drainage lines of the facility is capable of being connected; and a first and a second elongate extending member secured to an underside of said base, said elongate extending members each having a downwardly facing substantially "U" shape in cross section and extending in spaced apart and parallel fashion such that said elongate members are capable of receiving inserting portions of a conventional hydraulic operated fork lift.

2. The multi-functional and transportable wash station as described in claim 1, further comprising a power input means supplied to said body, a sewage ejection pump located along said outlet waste line and powered by said input means to propel waste water from said body and through the waste water drainage line.

3. The multi-functional and transportable wash station as described in claim 2, further comprising an electrically powered water heater operatively connected to said power input means and providing heated water to at least one of said non-potable water supplies.

4. The multi-functional and transportable wash station as described in claim 2, further comprising water chiller means operatively connected to said power input means and providing chilled water to at least one of said potable water supplies.

5. The multi-functional and transportable wash station as described in claim 1, further comprising a waste tank formed within said polygonal shaped base and in communication with said drainage lines and said outlet waste line.

6. The multi-functional and transportable wash station as described in claim 5, further comprising a lid hingedly connected to a selected upper surface of said base and being rotated upwardly to reveal an open interior accessing said waste tank.

7. The multi-functional and transportable wash station as described in claim 6, further comprising a particulate filter basket suspended within said open interior accessing said waste tank.

8. The multi-functional and transportable wash station as described in claim 1, said at least one potable water supply further comprising a water fountain.

9. The multi-functional and transportable wash station as described in claim 1, said at least one non-potable water supply further comprising a faucet with hot and cold running water, a sink being formed within a selected upper surface of said base and communicating with a selected one of said drainage lines.

10. The multi-functional and transportable wash station as described in claim 1, said at least one non-potable water supply further comprising a faucet with hot and cold running water, a running length of hose being connected to said faucet at a first selected end and a second selected end capable of being unwound to a remote location.

11. A multi-functional and transportable wash station for use in an industrial facility, the facility having pressurized water supply lines and waste water drainage lines, said wash station comprising:

a body having a polygonal shaped base and a superstructure extending upwardly from said base;

an inlet supply line extending from said body to which a selected one of the pressurized water supply lines of the facility is capable of being connected;

at least one potable water supply communicating with said inlet supply line and being issued at a first location from said body;

at least one non-potable water supply communicating with said inlet supply line and being issued at a second location from said body, said at least one non-potable water supply further including an emergency shower station, a shower head being mounted to an end of a feed line a horizontally spaced distance from an upper location of said superstructure, a pull chain being in pivotal operative communication with a flow valve located within said feed line and, upon being pulled, capable of activating said emergency shower; and drainage lines within said body which collect dirty water from said potable and non-potable water supplies, an outlet waste line in communication with said drainage lines and extending from said body and to which a selected one of the waste water drainage lines of the facility is capable of being connected.

* * * * *

UNITED STATES PATENT AND TRADEMARK OFFICE

CERTIFICATE OF CORRECTION

PATENT NO. : 6,253,394 B1
DATED : July 3, 2001
INVENTOR(S) : Dominic Goyette and Carl M. Bruke It is certified that error appears in the above-identified patent and that said Letters Patent is hereby corrected as shown below:

Column 4,
Line 53, replace "20" with -- 22 --.

Signed and Sealed this

Fourteenth Day of May, 2002

*Attest:*

*Attesting Officer*

JAMES E. ROGAN
*Director of the United States Patent and Trademark Office*